United States Patent [19]

Gars

[11] Patent Number: 4,833,806

[45] Date of Patent: May 30, 1989

[54] DISPLAY CELL ELEMENT FOR POINT MATRIX DISPLAY PANELS

[75] Inventor: Jacques L. Gars, Gambais, France

[73] Assignee: Societe D'Etudes Pour Le Developpement, France

[21] Appl. No.: 888,586

[22] Filed: Jul. 21, 1986

[30] Foreign Application Priority Data

Jul. 22, 1985 [FR] France ..... 85 11176

[51] Int. Cl.[4] ..... G09F 3/04

[52] U.S. Cl. ..... 40/447; 340/564

[58] Field of Search ..... 40/447, 446, 449, 450; 340/764, 815.2, 815.07, 765

[56] References Cited

U.S. PATENT DOCUMENTS 3,975,728 8/1976 Winrow ..... 40/447

FOREIGN PATENT DOCUMENTS 109328 5/1984 European Pat. Off. ..... 340/764

*Primary Examiner*—Gene Mancene

*Assistant Examiner*—J. Hakomakin

*Attorney, Agent, or Firm*—Andrus, Sceales, Starke & Sawall

[57] ABSTRACT

The present invention relates to a display cell element comprising a plate (2) with one reflecting side (3) and one black side (4). The plate (2) revolves between an active position when the reflective (3) side is showing, and a non-functioning position when the black side (4) is showing. The extremity (7) of a fiber optic cable (6) which transmits light is placed behind the plate (2), and the plate (2) is pierced with a hole (8) opposite the extremity (7) of the fiber optic cable (6) when the plate (2) is in its active position. Through the invention, a display panel with a good visual impact when seen from a great distance while being easily read from a shorter distance can be obtained.

9 Claims, 3 Drawing Sheets

FIG.3
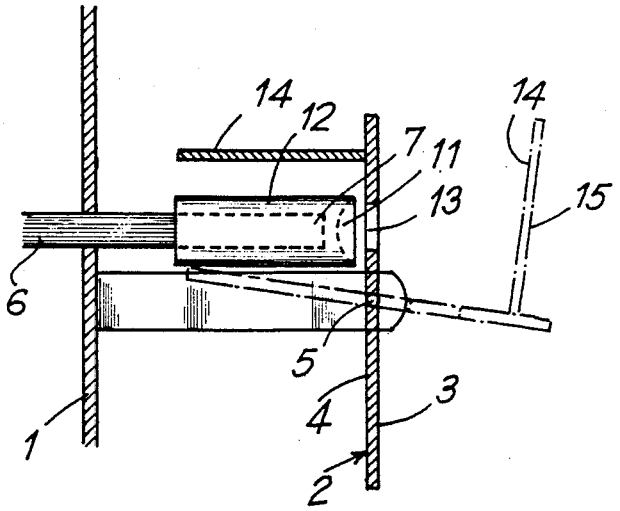
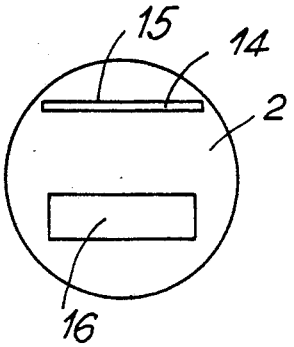
FIG.4

DISPLAY CELL ELEMENT FOR POINT MATRIX DISPLAY PANELS

This invention relates to point matrix display panels, i.e., panels on which each sign or symbol is represented by means of a point matrix, each point consisting in a display cell; each matrix being driven by a device (an electronic device in most cases) so as to display the sign or symbol required by activating a number of matrix cells. These matrices may be of the 7 lines, 5 columns type.

This invention deals more especially with display panels which need to be seen from a great distance so as to attract the attention of the individuals who will read the indications inscribed on the panel as they come closer. This is particularly the case for panels set up on thoroughfares for automotive traffice such as highways. Messages concerning safety have to be conveyed, and the panels which carry such messages must be noticed from a great distance even if they cannot be read at once, taking into account the travel speed of the vehicles. In other terms, the attention of the driver must be attracted when the panel is still a long way away in order to avoid chain pile-ups.

Display panels on which each cell element consists in a plate with one reflective side and one black side, this plate being mounted so as to rotate between the ON position (when it shows its reflective side) and the OFF position (black side showing) are well known. The matrix assembly of this display panel is lit by a luminous source such as a neon lamp. These display panels are easy to read from a short or an average distance and their technology is reliable. However, they are not sufficiently "aggressive" from a great distance and thus do not attract the attention of a driver who is still a long way away, so that he may discover the panel too late to read it or to react in order to avoid an accident.

There are also display matrices in which each cell is made out of the extremity of a fiber optic cable, the other extremity receiving light from a luminous source. A screening device may be placed in front of the outgoing extremity of the fiber optic cable. A display panel of this type, described in French patent application No. 2,535,882 offers a very strong visual impact even under unfavorable conditions such as fog, so that it may be noticed from a great distance. However, the beam emitted by each fiber optical cable produces a closed solid angle of 12° for instance at half-way power, so that it can only be observed from a great distance, taking into account that the panel is set quite high and that the driver arrives rapidly under the area swept by the fiber optical beams. Thus, he cannot read or make out the message inscribed on the panel.

This invention proposes to create a display cell element of the type indicated in the introduction, endowed with a strong luminous impact while preserving a largely open visual angle.

The display cell element referred to is especially remarkable in that the extremity of a light transmitting fiber optical cable is set behind the plate with one reflective side and one black side, said plate being pierced with a hole opposite to the extremity of the fiber optical cable when the latter is in the ON position. Thus, in the "ON" position, the beam emitted by the fiber optic cable goes through the hole in the plate so that the display point thus formed has a strong visual impact which attracts the attention of the user while he is still a long distance away; on the other hand, the passage of the beam through the plate in active (ON) position reinforces the reflective action of the latter. When the cell is in the "OFF" position, the plate tilts to show its black side and hides the beam emitted by the fiber optical cable, so that no light is emitted by the cell.

In one type of application, the plate consists in a round disc pivoting around a diametrical axis.

One advantage is that the extremity of the fiber optic cable is fastened on the printed drive circuit of the cell matrix and goes perpendicularly through the circuit. In this way, precise positioning of the fiber optic cables can be obtained, since the holes in the printed circuit are pierced as the printed circuit is being constructed. Thus, the fiber optic cables are set in a precise manner and at reasonable cost.

The fiber optical assembly of the cells of one display panel is lit by a common intense luminous source. An advantage is that this luminous source is the one which illuminates the plates when they are in the active (ON) position. Thus, the incorporation of fiber optic cables in the display cell matrix with revolving plates is effected at low cost since the fiber optic system is the only added component.

Other characteristics and advantages of this invention will become apparent from the following description and the annexed drawings in which:

FIG. 3 shows a variation in the design of the invention.

FIG. 4 shows one type of revolving plate.

Figure 1:
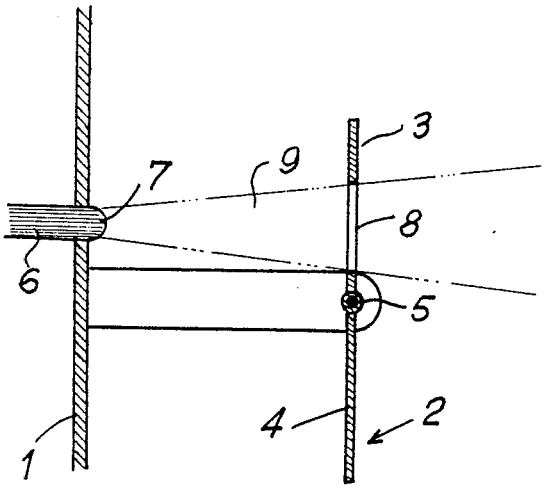
FIG. 1 shows a display cell element according to the invention, in the "ON" position.
Figure 2:
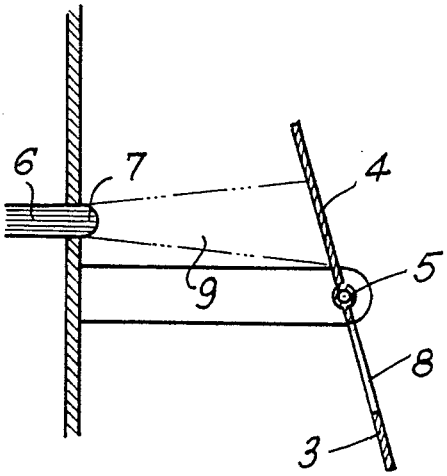
FIG. 2 shows the display cell of FIG. 1 in the "OFF" position.

In FIGS. 1 and 2. a display cell element forming part of a matrix of the 7×5 type, for example, has been represented. The cell assembly of each matrix is supported by a printed circuit 1 which serves to support each cell and is also the electronic drive circuit of the matrix.

Each cell element essentially consists in a plate 2 with one reflective side 3 and one black side 4. This plate which, for example, can be a round disc revolving around a horizontal diametrical axis 5 is driven by an electro-mechanical device such as an electro-magnet so as to be able to achieve two stable positions; a first "ON" position shown in FIG. 1, in which the reflective side 3 is directed towards the outside facing the user, and an "OFF" position in which plate 2 has rotated of 90° at least so as to show its black side 4 on the outside.

According to the invention, a fiber optic cable 6 is supplied at one extremity from a powerful luminous source; the outgoing extremity 7 is placed behind plate 2 pierced with a hole 8 facing extremity 7 of fiber optic cable 6 when plate 3 is on the "ON" position as shown in FIG. 1. The diameter of the hole is such as to admit in its entirety beam 9 emitted by extremity 7 of fiber optic cable 6; the solid angle of the beam is, for example, of 12°.

An advantage is that extremity 7 of fiber optic cable 6 goes perpendicularly through the support printed circuit 1 and is affixed onto its. Extremity 7 of fiber optic cable 6 being situated very close to the printed circuit 1, very precise positioning of extremity 7 and, consequently, of beam 9 which it is emitting, can be obtained.

Figure 5:
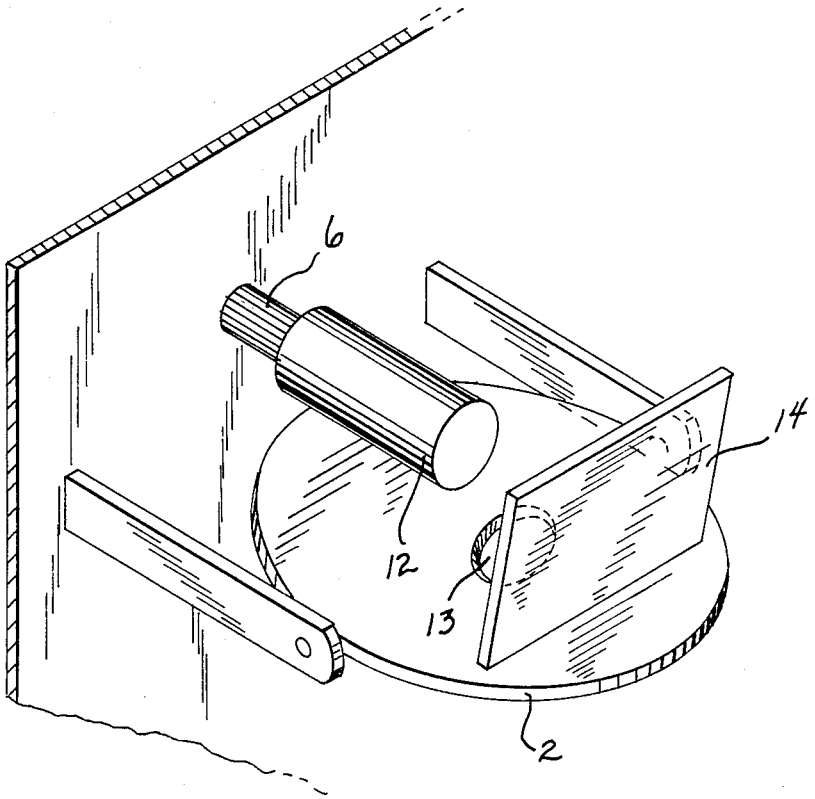
FIG. 5 is a perspective view of the embodiment of the invention shown in FIGS. 3 and 4.

FIGS. 3 and 5 show another type of application of the invention in which extremity 7 of fiber optic cable 6 is brought close to the revolving plate 2 and is fitted with a lens 11. It is known that lens 11 is supported by a socket 12 engaged onto the extremity of fiber optic cable 6. Because of this arrangement, hole 13 of plate 2 is much smaller, which limits the loss of reflective surface 3 due to the use of the fiber optic system. Moreover, it improves the operation of the cell element, especially when facing the sun.

In FIG. 3, it can also be seen that the semi-reflective plate 2 cannot tilt completely as in the example of FIG. 1, since the fiber optic cable comes close to the plate when the latter is in a reflective position and when extremity 7 of the fiber optic cable with the socket 12 stands in the way of the revolution of the semi-reflective plate 2. In this non-active position, represented in FIG. 3 by a broken line, the semi-reflective plate does not stand in the way of the fiber optic cable 6. This is why an obstruction component consisting, for example in a flat component perpendicularly affixed onto black side 4 has been provided on the black side 4 of the semi-reflective disc. In the "OFF" (non-functioning) position of the semi-reflective disc 2, this component 14 intervenes on the path of the luminous beam emitted by fiber optic cable 6. Of course, the side 15 of this obstruction component 14, which is directed towards the outside in the non-functioning position is not reflective. This obstruction component can be, for example, a sheet of synthetic material such as that known commercially as MYLAR, which makes it very inexpensive.

In order to improve perception of the display device from a distance, several fiber optic cables may be set side by side in each elementary cell. In this case, as shown in FIG. 4, a larger hole is provided on plate 2; it can be an oblong hole as shown in 16 in FIG. 4.

Another advantage is that all fiber optic cables of the display cells which make a display panel are supplied by a common high power luminous source; the input extremities of the fiber optic assembly 6 can be placed in front of the luminous source which serves to illuminate reflective plates 2. In this case, changes to be effected on a regular display panel with revolving plates are limited to the implantation of the fiber optic system 6.

In order to improve the aggressiveness of the display panels made out of cells according to the invention, the fiber optic system can be supplied by a luminous source, yellow or red, for example; also, holes 8, 13 and 16 can be fitted with a colored translucent sheet.

It can be seen that with this invention, an especially reliable display panel can be obtained since it is based upon the technology of display panels with reflective plates, which is extremely reliable; the addition of a fiber optic system to such display panels does not require any change in the operation of the panels, and they retain their reliability. On the other hand, the integration of the fiber optic system allows for a sharp increase in the aggressiveness of the panels.

In other respects, the use of obstruction components helps to improve operation without unduly increasing manufacturing costs; this is particularly important as regards large size semi-reflective plates.

Thus, for highway display, panels perceived from a distance of 300 m. can be made by utilizing fiber optic cables with a diameter of 0.6 cm.

The above description is for illustrative purposes only and is in no way restrictive. It is evident that changes or alternatives can be made while remaining within the framework of the invention.

I claim:

1. A display cell element for a point matrix display panel having an exposed face that can be viewed, said element comprising:

a supporting frame;

a plate mounted in said frame on an axis laying in the plane of the plate and extending through the central portion of the plate, said plate having a first side and a second side and rotating about said axis between an "on" position in which said first side is showing on the exposed face of the element and an "off" position in which said first side is not showing on the exposed face of the element, said plate having an opening therein spaced from said axis;

means for moving said plate between said "on" position and said "off" position;

means for constraining said plate to rotate through an arc of substantially 90° when moving between said "on" and "off" positions;

optical fiber cable means having an input end and an output end, said output end of said optical fiber cable means being mounted in the display cell element such that it is in line with the opening of said plate when said plate is in the "on" position, said output end being closely proximate to said second side of said plate when said plate is in said "on" position for reducing the size of said opening and loss of surface area of said plate; and illuminating means having the input end of said optical fiber cable means coupled thereto, said cable means transmitting the light of said illuminating means to said output end for projection through the opening of said plate when said plate is in the "on" position;

said plate having light obstruction means extending generally normal to said second side of said plate for blocking the light projected from the output end of said optical fiber cable means when said plate is in said "off" position.

2. The display cell element according to claim 1 wherein said output end of said optical fiber cable means is fitted with a lens.

3. The display cell element according to claim 2 wherein said lens is contained in a socket embracing the output end of said optical fiber cable means.

4. The display cell element according to claim 1 wherein said opening in said plate is provided with a light transmitting colored sheet.

5. The display cell element according to claim 1 wherein said opening is formed such that the entire beam of light emitted by said output end of said optical fiber cable means is passed through said opening.

6. The display cell element according to claim 1 further including a plurality of optical fiber cable means aligned with the opening of said plate when said plate is in the "on" position.

7. The display cell element according to claim 1 wherein said illuminating means further illuminates the exposed face of the point matrix display panel.

8. The display cell element according to claim 1 further including printed circuit means mounted in said frame proximate to said plate and wherein said output end of said optical fiber cable means is mounted in said printed circuit means.

9. A point matrix display panel comprising:

a supporting frame;

a plurality of display cell elements arranged in said matrix, said matrix having an exposed face that can be viewed, each of said display cell elements comprising:

a plate mounted in said frame on an axis lying in the plane of the plate and extending through the central portion of the plate, said plate having a first side and a second side and rotating about said axis between an "on" position in which said first side is showing on the exposed face of the element and an "off" position in which said first side is not showing on the exposed face of the element, said plate having an opening therein spaced from said axis;

means for moving said plate between said "on" position and said "off" position;

means for constraining said plate to rotate through an arc of substantially 90° when moving between said "on" and "off" positions;

optical fiber cable means having an input end and an output end, said output end of said optical fiber cable means being mounted in the display cell element such that it is in line with the opening of said plate when said plate is in the "on" position, said output end being closely proximate to said second side of said plate when said plate is in said "on" position for reducing the size of said opening and loss of surface area of said plate; and illuminating means having the input end of said optical fiber cable means coupled thereto, said cable means transmitting the light of said illuminating means to said output end for projection through the opening of said plate when said plate is in the "on" position;

said plate having light obstruction means extending generally normal to said second side of said plate for blocking the light projected from the output end of said optical fiber cable means when said plate is in said "off" position.

* * * * *

UNITED STATES PATENT AND TRADEMARK OFFICE

CERTIFICATE OF CORRECTION

PATENT NO. : 4,833,806

DATED : May 30, 1989

INVENTOR(S) : Jacques Le Gars

It is certified that error appears in the above-identified patent and that said Letters Patent is hereby corrected as shown below:

Title Page, correct inventor's name from "Jacques L. Gars" to ---Jacques Le Gars---

| | |
|---|---|
| Column 1, line 61 | delete "optical" and substitute therefor ---optic--- |
| Column 1, line 63 | delete "optical" and substitute therefor ---optic--- |
| Column 2, lines 5-6 | delete "optical" and substitute therefor ---optic--- |
| Column 2, line 17 | delete "optical" and substitute therefor ---optic--- |
| Column 2, line 57 | delete "on" in the first occurrence and substitute therefor ---in--- |
| Column 2, line 64 | delete "its" and substitute therefor ---it--- |
| Claim 1, Column 4, line 8 | delete "laying" and substitute therefor ---lying--- |

Signed and Sealed this

Twenty-seventh Day of November, 1990

*Attest:*

*Attesting Officer*

HARRY F. MANBECK, JR.

*Commissioner of Patents and Trademarks*